US006460625B1

(12) United States Patent
Hales et al.

(10) Patent No.: US 6,460,625 B1
(45) Date of Patent: Oct. 8, 2002

(54) SLOPEBOARD MOUNTING LINKAGE

(76) Inventors: Roy A. Hales, 1253 N. Bedford Ct., Camarillo, CA (US) 93010; Jeremy A. Jenkins, 765 E. Center St., Logan, UT (US) 84321; Clay Carter, 1049 E. 2100 North, North Logan, UT (US) 84341; Flint Hamblin, 1355 N. 800 East, Apt. 6C, Logan, UT (US) 84341

( * ) Notice: Subject to any disclaimer, the term of this patent is extended or adjusted under 35 U.S.C. 154(b) by 0 days.

(21) Appl. No.: 09/640,885

(22) Filed: Aug. 18, 2000

(51) Int. Cl.[7] ..... E02F 3/85
(52) U.S. Cl. ..... 172/812; 37/281
(58) Field of Search ..... 172/810, 811, 172/812, 815, 782, 786; 37/105, 274, 281

(56) References Cited

U.S. PATENT DOCUMENTS 1,343,533 A * 6/1920 Ursino ..... 172/815
2,348,796 A * 5/1944 Ferwerda et al. ..... 172/815
2,659,988 A * 11/1953 Braden et al. ..... 172/815
2,833,059 A * 5/1958 Shipley ..... 37/105
3,429,381 A * 2/1969 Launder et al. ..... 172/815
3,445,944 A * 5/1969 Speno ..... 37/105
3,464,499 A * 9/1969 McKell ..... 172/802
3,726,347 A * 4/1973 Hyman ..... 172/782
3,815,268 A * 6/1974 Yard ..... 37/105
4,045,892 A * 9/1977 Farrell ..... 37/105
4,068,726 A * 1/1978 Heitman ..... 172/802
4,079,791 A * 3/1978 Yoder et al. ..... 172/802
4,223,461 A * 9/1980 Tackitt ..... 37/105
4,357,766 A * 11/1982 Croteau ..... 37/281
4,706,395 A * 11/1987 Cicin-Sain ..... 37/105
4,953,625 A * 9/1990 Hurworth ..... 172/305
5,600,903 A * 2/1997 McCray ..... 37/105

* cited by examiner

*Primary Examiner*—Thomas B. Will
*Assistant Examiner*—Kristine Markovich
(74) *Attorney, Agent, or Firm*—Thompson E. Fehr

(57) ABSTRACT

A slopeboard mounting linkage that raises a slopeboard while also raising and moving a fluid-powered cylinder toward the longitudinal center of the bulldozer to which the cylinder and slopeboard are attached. One end of a rod extending from the cylinder is rotatably attached to the slopeboard as is also one end of a link arm. The other ends of the cylinder and of the link arm are rotatably attached to an angled link that is rotatably attached to the back of the primary push blade of the bulldozer. And the inside edge of the slopeboard is rotatably attached to a long arm of the bulldozer.

16 Claims, 4 Drawing Sheets

SLOPEBOARD MOUNTING LINKAGE

BACKGROUND OF THE INVENTION

1. Field of the Invention

This invention relates to slopeboard mountings for use with tractors having a primary push blade.

2. Description of the Related Art

A slopeboard is a subsidiary blade for use with tractors having a primary push blade.

Such tractors are most commonly termed bulldozers, a term which seems to have become generic for designating a crawler-mounted tractor equipped with a primary push blade, even though the term was originally a trademark of the Caterpillar Corporation.

The slopeboard enables the tractor to cut an angle on earth adjacent to the tractor, for example, to create the slope along the side of a road that cuts through a hill.

Three patents are known to the inventors which apply to slopeboards, viz., U.S. Pat. Nos. 4,068,726; 4,079,791; and 4,223,461.

All three of these patents utilize a fluid-powered cylinder to extend and retract a rod. One end of the cylinder is attached relatively high on the back of the primary push blade, although the point of attachment for the cylinder of U.S. Pat. No. 4,223,462 appears to be somewhat lower than the point of attachment in the case of the other two patents.

The inside of the slopeboard near the edge closer to the primary push blade is rotatably attached to the primary push blade, and the free end of the rod is connected to the slopeboard farther out than the point of rotation. Therefore, extending the rod lowers the slopeboard; and retracting the rod raises the slopeboard. This works satisfactorily for the bulldozers illustrated in the three patents because such bulldozers do not have support arms for the primary push blade outside the wheels and tracks that propel such bulldozers and, consequently, relatively near the edges of the primary push blade. In fact, U.S. Pat. No. 4,079,791 explicitly declares, on lines 26 through 30 in column 2, "The sloping attachment (sometimes referred hereinafter as 'sloper blade/board device') as shown in FIG. 1 is mounted on any six way hydraulic angle and tilt bulldozer(s), with inside the track dozer arms . . . "

Larger bulldozers, however, have large arms to hold the primary push blade. These large arms are located outboard of the tracks, i.e., the plated endless belts which make contact with the ground and propel the bulldozer. In order to avoid colliding with these large arms, the hydraulic or pneumatic cylinder must be outside or above such large arms. Being outside the large arms would, though, likely subject the cylinder to damage from collisions with ground-mounted objects. Thus, a high location is preferable.

U.S. Pat. No. 3,429,380 does appear to deal with a slopeboard for a large bulldozer. The technique employed in that invention to avoid collisions between the large arms and the hydraulic or pneumatic cylinder is to have a hinge 9 attached to the edge of the primary push blade (designated mold plate 3) and to have the closed end of the hydraulic or pneumatic cylinder ". . . joined by a pivotal connection 18 to the upper extremity of the hinge structure 9 . . . "

The hydraulic or pneumatic cylinder is then protected by the extremely large triangular slopeboard of U.S. Pat. No. 3,429,380.

The slopeboard of U.S. Pat. No. 3,429,380 can, however, apparently not be raised significantly toward a ninety-degree position with respect to the bottom of the primary push blade; when it is not desired to use the slopeboard, the strut 33 must be mechanically disconnected before the slopeboard is swung by the hinge 9 to be alongside the bulldozer.

This leaves the hinge exposed to damage when the primary push blade is used. Such potential for damage to the hinge 9 would also occur if the slopeboard were removed, for example, because the operator of the bulldozer intended to have an extended period of operation during which the slopeboard would not be required.

The inventors have also observed an apparently unpatented slopeboard that avoids obstructions and protects the pneumatic or hydraulic cylinder by raising the cylinder as the slopeboard is raised. This device, though, creates a substantial obstruction in the field of view of the operator of the bulldozer.

A bar is pivotally attached behind but near an edge of the top of the primary push blade of the bulldozer. The closed end of a pneumatic or hydraulic cylinder is pivotally attached at an intermediate point along the bar. The rod that extends from the pneumatic or hydraulic cylinder is pivotally attached near the free end of the slopeboard; the other end of the slopeboard is pivotally attached to a long arm of the bulldozer. A first end of a link arm is pivotally attached to the slopeboard even nearer to the free end of the slopeboard than is the rod from the pneumatic or hydraulic cylinder. A second end of the link arm is pivotally attached to the free end of the bar.

As the rod is drawn into the cylinder, the free end of the slopeboard is thereby rotated upward forcing the link arm upward and rotating the bar upward, which rotation raises the cylinder. When the slopeboard is at or near the ninety-degree position with respect to the bottom of the primary push blade, however, both the cylinder and the link arm significantly obstruct the field of view for the operator of the bulldozer.

SUMMARY OF THE INVENTION

It is important to keep mounting points for the slopeboard within the width of the primary push blade in order to avoid damage to such mounting points, to have the slope board near to the edge of the primary push blade when the slopeboard has been raised to the ninety-degree position in order to minimize the risk of violating highway regulations concerning wide loads, to have the slopeboard adequately stabilized in any position, and to preclude the hydraulic or pneumatic cylinder that raises and lowers the slopeboard from striking any portion of or attachment on the primary push blade.

With respect to the bottom of the primary push blade on the tractor, the bottom of the slopeboard of the present invention can make an angle from zero degrees, i.e., even, with the bottom of the push blade to ninety degrees above the bottom of the push blade, ie., perpendicular to and above the bottom of the push blade.

When the slopeboard is at the bottom, the edge of the slopeboard is near the edge of the primary push blade and the bottom of the slopeboard is substantially aligned with the bottom of the primary push blade. Yet, when the slopeboard has been raised to the ninety-degree position, the bottom of the slopeboard is less than the height of the slopeboard from the edge of the primary push blade because of the angled support arm and because the slopeboard is so constructed and mounted to the bulldozer that the farther a point on the slopeboard is above the bottom of the slopeboard, the farther forward such a point is, thereby creating sufficient tilt that the upper portion of the slopeboard is in front of the primary push blade when the slopeboard has been raised to the ninety-degree position.

The angled support arm also permits the point of rotation to be mounted behind the primary push blade.

And, perhaps most significantly, the angled link of the Slopeboard Mounting Linkage causes the fluid-powered cylinder to be raised, and preferably moved toward the longitudinal center of the bulldozer, as such cylinder retracts the cylinder rod to rotate the slopeboard upward while minimizing obstructions to the field of vision for the operator of the bulldozer. This avoids collisions with any obstructions on the rear of the primary push blade while also keeping the mounting points behind the primary push blade.

For stability of the slopeboard, the angled link also causes the cylinder, angled link, and slopeboard substantially to create a triangular pattern when the slopeboard has been raised to the ninety-degree position, rather than having the cylinder generally in line with the raised slopeboard. And the slopeboard has three points from which it is attached to the primary push blade.

DESCRIPTION OF THE PREFERRED EMBODIMENT

Figure 1:
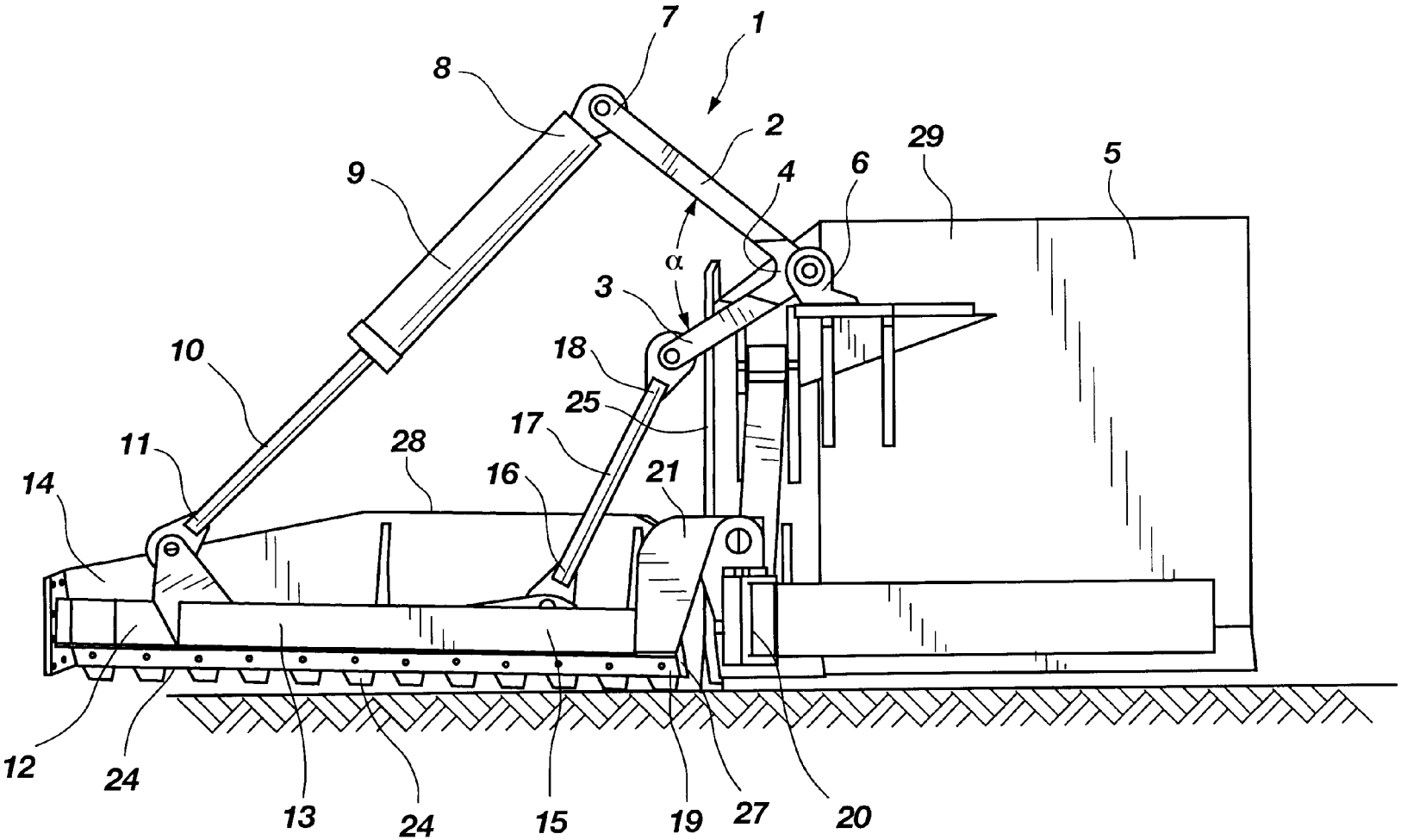
FIG. 1 portrays the Slopeboard Mounting Linkage from the rear with the slopeboard extended.
Figure 2:
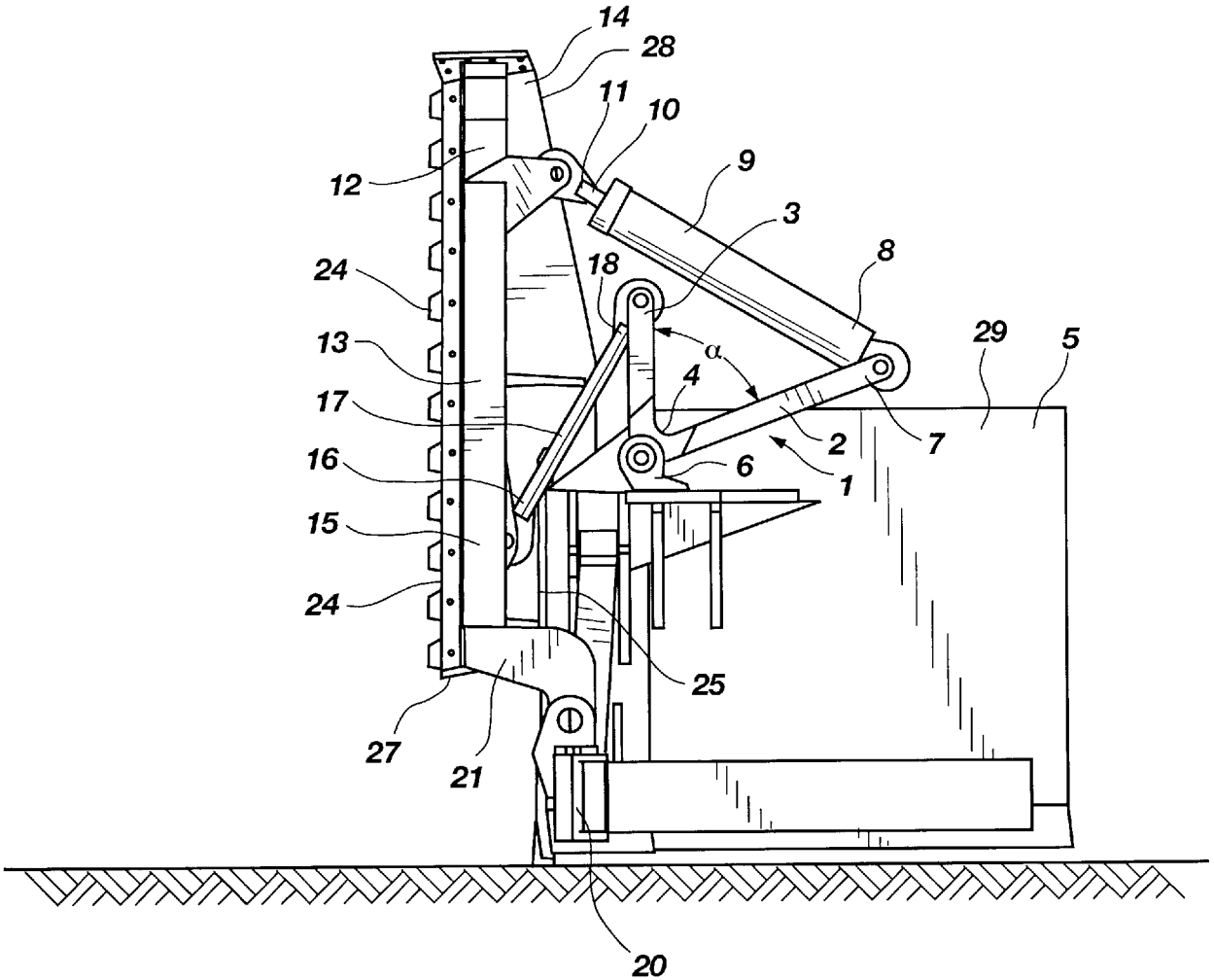
FIG. 2 shows the Slopeboard Mounting Linkage from the rear with the slopeboard completely raised.
Figure 4:
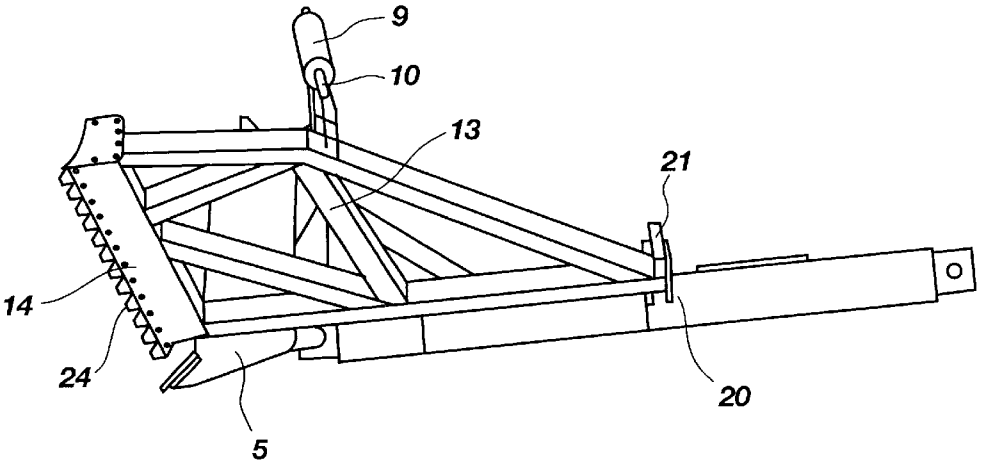
FIG. 4 depicts the side of the push blade of the bulldozer with the Slopeboard Mounting Linkage shown from below in a partially raised position.
Figure 3:
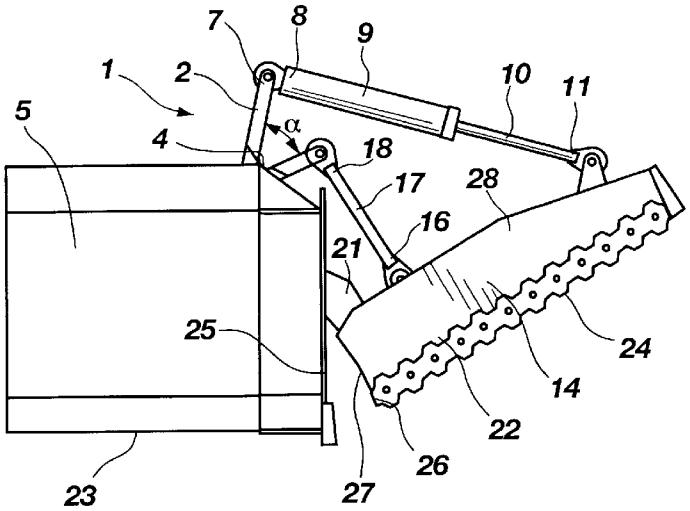
FIG. 3 illustrates the Slopeboard Mounting Linkage from the front.
Figure 5:
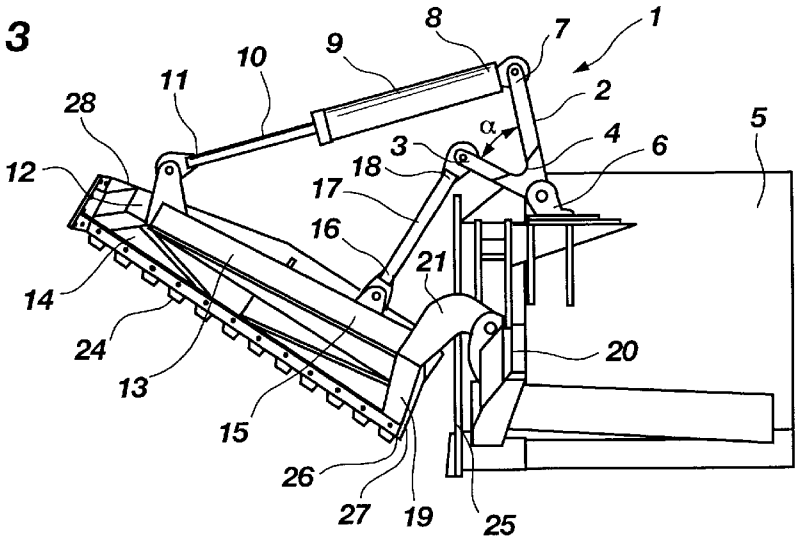
FIG. 5 is a view from the rear with the slopeboard in the same position as that of FIG. 4.
Figure 6:
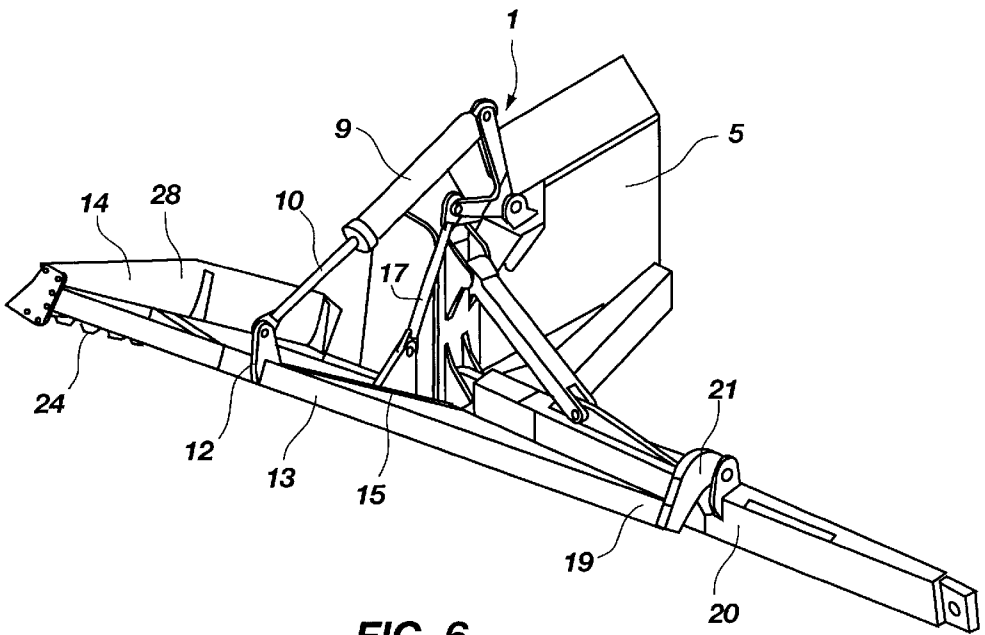
FIG. 6 is a view from above and to the rear of the Slopeboard Mounting Linkage with the slopeboard in the same position as that of FIG. 4 and FIG. 5.
Figure 7:
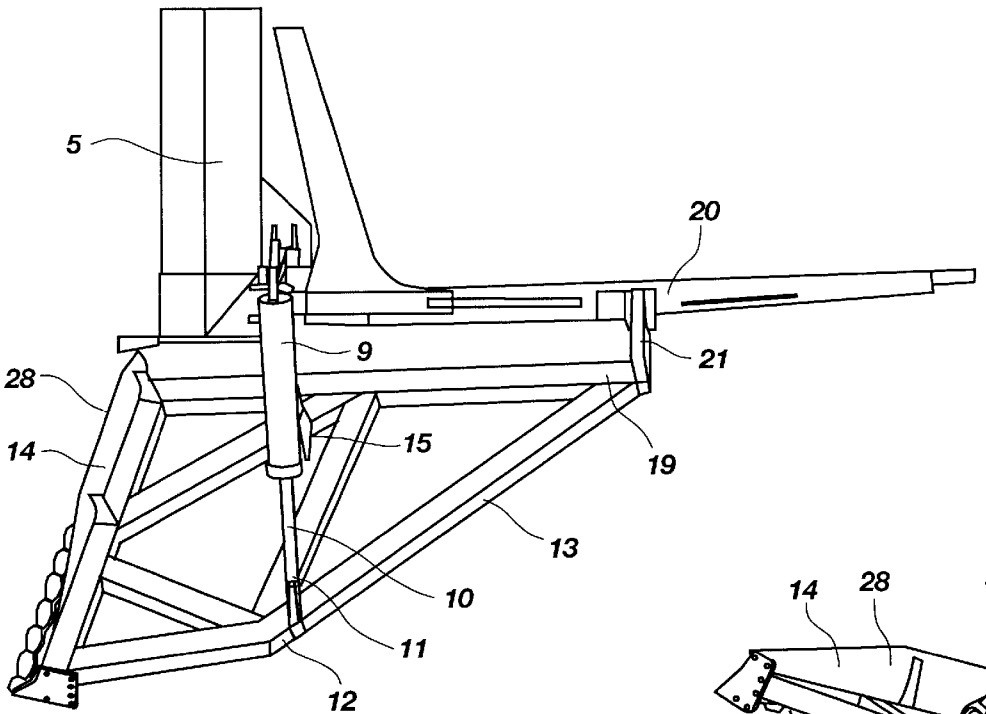
FIG. 7 is a view from the side and above the Slopeboard Mounting Linkage.

The preferred embodiment of the present Slopeboard Mounting Linkage employs an angled link 1 having a longer arm 2 which is attached to a shorter arm 3 at an acute angle α. Near its vertex 4, the angled link 1 is rotatably (The terms pivotally and rotatably are used herein as synonyms.) attached to the primary push blade 5, preferably by being pivotally mounted to a lug 6 that is connected to the primary push blade 5, preferably high on the back 29 of the primary push blade 5.

The free end 7 of the longer arm 2 is rotatably attached to the closed end 8 of a fluid-powered, preferably hydraulic or pneumatic, cylinder 9. A cylinder rod 10 exiting from the cylinder 9 has its free end 11 rotatably connected to the slopeboard 14, preferably through an outer portion 12 of a support structure 13 for the slopeboard 14 that is attached to said slopeboard 14. Rotatably connected to the slopeboard, preferably by being rotatably attached to an inner portion 15 of the support structure 13 is a first end 16 of a link arm 17. A second end 18 of the link arm 17 is rotatably connected to the end of the shorter arm 3 of the angled link 1 that is away from the vertex 4. And the inside edge 27 of the slopeboard 14 is adapted for rotatable attachment to a long arm 20 of the bulldozer, preferably by having the inside edge 19 of the support structure 13 rotatably attached to the long arm 20 with a support arm 21 that is preferably angled, although the support arm 21 could be straight.

Preferably, the Slopeboard Mounting Linkage is so designed that the bottom inside edge 26 of the front 22 of the slopeboard 14 will, when installed on a bulldozer and in its lowest position, be substantially aligned with the front 23 of the primary push blade 5 of the bulldozer and near the edge 25 of the primary push blade 5.

Operation of the Slopeboard Mounting Linkage can be understood by considering the slopeboard 14 initially to be in a completely lowered position.

In order to raise the slopeboard 14, the cylinder rod 10 is retracted, preferably hydraulically or pneumatically, into the cylinder 9. This causes the slopeboard 14 to rotate about the connection of support structure 13 for the slopeboard 14 to the long arm 19 of the bulldozer.

Such rotation pushes the inner portion 15 of the support structure 13 against the link arm 17. This in turn, because the inside angle α between the link arm 17 and the shorter arm 3 of the angled link 1 is less than 180 degrees, causes the angled link 1 to rotate upward about its vertex 4. The longer arm 2 of the link 1 thereby raises the cylinder 9, keeping the cylinder 9 and the entire Slopeboard Mounting Linkage clear of any obstructions. Moreover, because of the folding about the connection between the link arm 17 and the shorter arm 3 of the angled link 1 and because the link arm 17 and the shorter arm 3 are mounted below the fluid-powered cylinder 9, there is no obstruction to the field of view of the operator of the bulldozer other than that caused by the fluid-powered cylinder 9, itself.

When the slopeboard 14 has been raised to the ninety-degree position, the most distant portion of the slopeboard 14 from the longitudinal center of the bulldozer, viz., the bottom 24, is near the edge 25 of the push blade 5 because of the support arm 21 and because the slopeboard 14 is preferably so constructed and mounted to the bulldozer that the farther a point on the slopeboard 14 is above the bottom 24 of the slopeboard 14, the farther forward such a point is, thereby creating sufficient tilt that the upper portion 28 of the slopeboard 14 is in front of the primary push blade when the slopeboard has been raised to the ninety-degree position. And, again because of the folding about the connection between the link arm 17 and the shorter arm 3 of the angled link 1, the fluid-powered cylinder 9, the angled link 1, and the slopeboard 14 create a stabilizing triangular pattern when the slopeboard 14 has been raised to the ninety-degree position.

We claim:

1. A slopeboard mounting structure for a bulldozer in combination with a primary push blade with a back, a long arm, and a slopeboard having a bottom inside edge as well as a front and a bottom, which comprises:

an angled link having a longer arm attached at an acute angle to a shorter arm, said longer arm also having a free end and said angled link being, at a vertex formed by the longer arm and the shorter arm, rotatably attached to the primary push blade high on the back of the primary push blade;

a fluid-powered cylinder having a closed end and an end from which a cylinder rod having a free end exits, the closed end of said cylinder being rotatably attached to the free end of the longer arm of said angled link and the free of the cylinder rod being adapted for rotatable connection to a slopeboard;

a link arm having a first end and a second end with said first end being adapted for rotatable connection to a slopeboard and with said second end rotatably connected to the end of the shorter arm of said angled link that is away from the vertex of the angled link; and a support arm attached to the slopeboard and adapted for rotatable attachment to a long arm of the bulldozer.

2. The slopeboard mounting structure for a bulldozer in combination with a primary push blade with a back, a long arm, and a slopeboard having a bottom inside edge as well as a front and a bottom as recited in claim 1, wherein:

said fluid-powered cylinder is a hydraulic cylinder.

3. The slopeboard mounting structure for a bulldozer in combination with a primary push blade with a back, a long arm, and a slopeboard having a bottom inside edge as well as a front and a bottom as recited in claim 2, further comprising:

a support structure attached to said slopeboard wherein the free end of the cylinder rod of said cylinder is rotatably connected to the slopeboard by being rotatably attached to an outer portion of said support structure, the first end of said link arm is rotatably connected to the slopeboard by being rotatably attached to an inner portion of said support structure, and said support arm is attached to the slopeboard by being connected to said support structure.

4. The slopeboard mounting structure for a bulldozer in combination with a primary push blade with a back, a long arm, and a slopeboard having a bottom inside edge as well as a front and a bottom as recited in claim 3, wherein:

the front of the slopeboard is, when installed on a bulldozer and when the slopeboard is in its lowest position, substantially aligned with the front of the primary push blade of the bulldozer and near the edge of the primary push blade; and the farther a point on the slopeboard is above the bottom of the slopeboard, the farther forward such a point is.

5. The slopeboard mounting structure for a bulldozer in combination with a primary push blade with a back, a long arm, and a slopeboard having a bottom inside edge as well as a front and a bottom as recited in claim 4, wherein:

said support arm is angled.

6. The slopeboard mounting structure for a bulldozer in combination with a primary push blade with a back, a long arm, and a slopeboard having a bottom inside edge as well as a front and a bottom as recited in claim 3, wherein:

said support arm is angled.

7. The slopeboard mounting structure for a bulldozer in combination with a primary push blade with a back, a long arm, and a slopeboard having a bottom inside edge as well as a front and a bottom as recited in claim 2, wherein:

the front of the slopeboard is, when installed on a bulldozer and when the slopeboard is in its lowest position, substantially aligned with the front of the primary push blade of the bulldozer and near the edge of the primary push blade; and the farther a point on the slopeboard is above the bottom of the slopeboard, the farther forward such a point is.

8. The slopeboard mounting structure for a bulldozer in combination with a primary push blade with a back, a long arm, and a slopeboard having a bottom inside edge as well as a front and a bottom as recited in claim 7, wherein:

said support arm is angled.

9. The slopeboard mounting structure for a bulldozer in combination with a primary push blade with a back, a long arm, and a slopeboard having a bottom inside edge as well as a front and a bottom as recited in claim 2, wherein:

said support arm is angled.

10. The slopeboard mounting structure for a bulldozer in combination with a primary push blade with a back, a long arm, and a slopeboard having a bottom inside edge as well as a front and a bottom as recited in claim 1, further comprising:

a support structure attached to said slopeboard wherein the free end of the cylinder rod of said cylinder is rotatably connected to the slopeboard by being rotatably attached to an outer portion of said support structure, the first end of said link arm is rotatably connected to the slopeboard by being rotatably attached to an inner portion of said support structure, and said support arm is attached to the slopeboard by being connected to said support structure.

11. The slopeboard mounting structure for a bulldozer in combination with a primary push blade with a back, a long arm, and a slopeboard having a bottom inside edge as well as a front and a bottom as recited in claim 10, wherein:

the front of the slopeboard is, when installed on a bulldozer and when the slopeboard is in its lowest position, substantially aligned with the front of the primary push blade of the bulldozer and near the edge of the primary push blade; and the farther a point on the slopeboard is above the bottom of the slopeboard, the farther forward such a point is.

12. The slopeboard mounting structure for a bulldozer in combination with a primary push blade with a back, a long arm, and a slopeboard having a bottom inside edge as well as a front and a bottom as recited in claim 11, wherein:

said support arm is angled.

13. The slopeboard mounting structure for a bulldozer in combination with a primary push blade with a back, a long arm, and a slopeboard having a bottom inside edge as well as a front and a bottom as recited in claim 10, wherein:

said support arm is angled.

14. The slopeboard mounting structure for a bulldozer in combination with a primary push blade with a back, a long arm, and a slopeboard having a bottom inside edge as well as a front and a bottom as recited in claim 1, wherein:

the front of the slopeboard is, when installed on a bulldozer and when the slopeboard is in its lowest position, substantially aligned with the front of the primary push blade of the bulldozer and near the edge of the primary push blade and the farther a point on the slopeboard is above the bottom of the slopeboard, the farther forward such a point is.

15. The slopeboard mounting structure for a bulldozer in combination with a primary push blade with a back, a long arm, and a slopeboard having a bottom inside edge as well as a front and a bottom as recited in claim 14, wherein:

said support arm is angled.

16. The slopeboard mounting structure for a bulldozer in combination with a primary push blade with a back, a long arm, and a slopeboard having a bottom inside edge as well as a front and a bottom as recited in claim 1, wherein:

said support arm is angled.

* * * * *